United States Patent [19]

Saito

[11] 4,451,140

[45] May 29, 1984

[54] CLEANING BLADE UNIT

[75] Inventor: Kinzi Saito, Kanagawa, Japan

[73] Assignee: Ricoh Company, Ltd., Japan

[21] Appl. No.: 448,044

[22] Filed: Dec. 8, 1982

[30] Foreign Application Priority Data

Dec. 14, 1981 [JP] Japan ..... 56-201206

[51] Int. Cl.[3] ..... G03G 21/00

[52] U.S. Cl. ..... 355/15; 15/256.51

[58] Field of Search ..... 355/15, 3 R; 15/265.5, 15/256.51; 118/652

[56] References Cited

U.S. PATENT DOCUMENTS 4,247,196 1/1981 Ogawa et al. ..... 355/15

4,284,345 8/1981 Sugiyama et al. ..... 355/15

FOREIGN PATENT DOCUMENTS 54-71646 6/1979 Japan ..... 355/15

*Primary Examiner*—R. L. Moses

*Attorney, Agent, or Firm*—Guy W. Shoup

[57] ABSTRACT

A cleaning blade unit for removing residual toner from a photosensitive member includes a first arm which carries a blade, and a second arm which carries the first arm in an angularly movable manner and is pivotally mounted on a stationary member. Both of the arms are urged to move angularly in a direction to bring the forward edge of the blade into abutment against the photosensitive member. When the forward edge of the blade is resisted by residual toner, the forward edge is urged against the photosensitive member with an increased force, thus effectively achieving a removal of residual toner.

7 Claims, 3 Drawing Figures

CLEANING BLADE UNIT

BACKGROUND OF THE INVENTION

This invention relates to a cleaning blade unit for removing any residual toner from the surface of a latent image carrier after a transfer step in an electrophotographic apparatus or electrostatic recording system.

As is well recognized, a cleaning balde unit includes a cleaning blade which may be disposed with respect to the surface of a latent image carrier at an angle greater than 90° (leading edge contact type) or less than 90° (trailing edge contact type). An arrangement of the leading edge contact type is disclosed in Japanese Patent Publication No. 034,340/1979 while an arrangement of the trailing edge contact type is disclosed in Japanese Laid-Open Patent Application No. 093,036/1978.

In an arrangement of the leading edge contact type, the forward edge of the cleaning blade abuts against the surface of the moving latent image carrier in a direction opposite from the direction of movement of the carrier in order to remove any residual toner therefrom. If an increased amount of toner remains on the surface of the carrier or if the toner firmly adheres to the surface of the carrier, an increased resistance which the forward edge of the blade causes the edge to bite into the surface of the carrier, thus enhancing the removal effect. By contrast, in an arrangement of the trailing edge contact type, the forward edge of the cleaning blade abuts against the surface of the moving latent image carrier in a forward direction, as viewed in the direction of movement of the carrier. Hence, the presence of an increased amount of toner or firmly adhering toner on the carrier surface produces a resistance which causes the forward edge to be lifted, thus reducing the force of abutment and hence the cleaning effect. For this reason, the forward edge of the blade is strongly urged against the carrier surface from the very beginning in an arrangement of the trailing edge contact type. However, this causes the blade or the carrier surface to be damaged or its useful life to be reduced as a result of fatigue. Accordingly, it is necessary to hold the forward edge of the blade removed from the carrier surface when no cleaning operation is to be performed. This results in a complex construction and an increased cost. In an arrangement of the trailing edge contact type as disclosed in Japanese Laid-Open Patent Application No. 041,451/1980, for example, a spring is used to maintain the forward edge of the blade against the carrier surface under a given pressure. However, the result obtained is the achievement of a limited force of abutment, and such force cannot be increased in the presence of an increased amount of toner or firmly adhering toner, foreclosing the possibility to achieve a greater cleaning effect.

SUMMARY OF THE INVENTION

In accordance with the invention, there is provided a cleaning blade unit comprising a cleaning blade disposed in contact with a surface of a latent image carrier which is to be cleaned, at an angle equal to or less than 90°, a first holding member for holding the blade, a second holding member for carrying the first holding member in an angularly movable manner and being pivotally mounted on the unit, a spring member engaging with both the first and the second holding members for urging the first holding member to move angularly in a direction to bring the forward edge of the blade into abutment against the surface of the latent image carrier, and a bias member for urging the second holding member to move angularly in the same direction as the first holding member.

In accordance with the invention, the first holding member which holds the cleaning blade and the second holding member which holds the first holding member are both urged to move angularly in a direction to bring the forward edge of the blade into abutment against the surface of the latent image carrier, so that when the forward edge undergoes a resistance produced by any residual toner, an intermediate floating fulcrum between both the holding members is displaced in the same direction as the direction of movement of the surface of the latent image carrier while the forward edge of the blade is maintained in abutment against the surface of the carrier, thus applying a force to the first holding member in a direction which is opposite from the direction in which it is to move angularly. This increases the force of abutment of the forward edge of the blade against the surface of the carrier, allowing an increased amount of toner or firmly adhering toner to be entirely removed from the surface of the carrier.

Therefore, it is an object of the invention to provide an improved cleaning blade unit of the trailing edge contact type which is simple in construction and inexpensive while assuring a satisfactory cleaning effect.

The above and other objects of the invention will become apparent from the following description with reference to the attached drawings.

DESCRIPTION OF THE PREFERRED EMBODIMENTS

Figure 1:
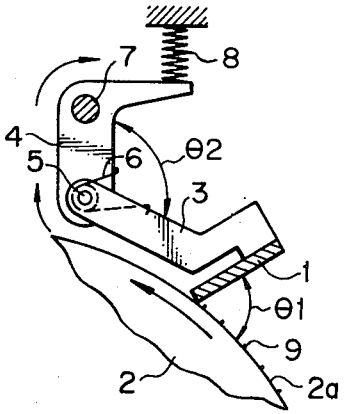
FIG. 1 is a schematic illustration of a cleaning blade unit according to one form of the invention.

Referring to FIG. 1, there is shown a cleaning blade 1 which is disposed in contact with a surface 2*a* of a drum-shaped latent image carrier 2 that is yet to be cleaned, at an angle $\theta_1$ which is equal to or less than 90°. The cleaning blade 1 is fixedly mounted to the front edge of a first holding member 3, the rear end of which is pivotally mounted on the lower end of an L-shaped second holding member 4 by means of a pin 5. A torsion spring 6 is disposed on the pin 5, and has its one end engaged with the first holding member 3 and its other end engaged with the second holding member 4, thus urging the first holding member 3 to move angularly in a direction to bring the forward edge of the blade 1 into abutment against the surface of the latent image carrier 2. At its bend, the second holding member 4 is pivotally mounted on the unit, and a coiled compression spring 8 is disposed between the upper end of the second holding member and the unit to urge the second holding member 4 to move angularly in the same direction as the first holding member 3. Accordingly, the forward edge of the blade 1 is maintained in abutment against the surface of the latent image carrier under the bias produced by both springs 6 and 8.

Assuming that there remains firmly adhering toner 9 on the surface 2*a* of the carrier 2 which is yet to be cleaned, the movement of the surface of the carrier 2 causes the forward edge of the blade 1 to be urged by such adhering toner 9 in the same direction as the direction of movement of the carrier. As a result, a floating fulcrum 5, defined by the joint between the holding members 3 and 4, moves in the same direction, but the bias produced by both of the spring 6 and 8 maintains the forward edge of the blade 1 in abutment against the carrier surface. However, it is to be noted that as a result of such displacement of the fulcrum 5, an angle $\theta_2$ defined between the first and the second holding member 3 and 4 decreases, whereby the forward edge of the blade 1 is urged against the carrier surface with an increased force in a manner so as to bite into the carrier surface. The greater the magnitude of the resistance which the forward edge of the blade 1 undergoes due to the presence of the toner 9, the greater will be an increase in the force of abutment, thus enhancing the resulting cleaning effect. Accordingly, if an increased amount of toner or firmly adhering toner exists on the carrier surface, the force of abutment applied to the blade will increase proportionately. Conversely, if the amount of residual toner decreases, the force of abutment will decrease proportionately. In this manner, any residual toner on the carrier can be entirely removed, without leaving any residue. On the other hand, when no cleaning operation is performed or when the amount of residual toner present is small, the force of abutment will be relatively low. Hence, when not in use, it is unnecessary to maintain the blade removed from the carrier surface, resulting in an arrangement which is simple in construction and inexpensive while avoiding any likelihood of damaging the blade or the carrier surface to reduce their useful life. As compared with a usual arrangement of the leading edge contact type, the invention allows the magnitude of the force of abutment applied to the forward edge of the blade, as well as the rate of increase of such force in response to the resistance created by the toner to be chosen freely through a choice of the spring member thereby or the bias member, permitting an optimum cleaning operation.

Figure 2:
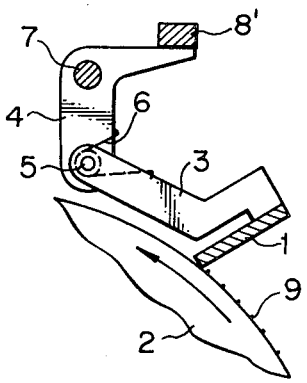
FIG. 2 is a schematic view of a cleaning blade unit according to another form of the invention.
Figure 3:
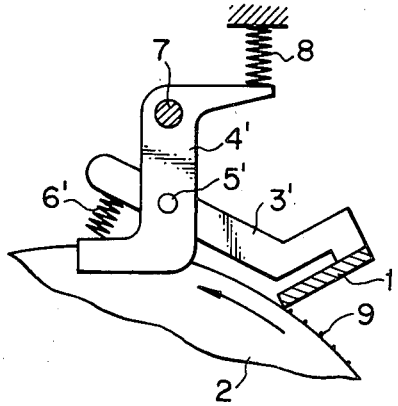
FIG. 3 is a schematic view of a cleaning blade unit according to a further form of the invention.

The bias member which urges the second holding member to move angularly, as illustrated by the compression spring 8 in FIG. 1, may also comprise a weight 8' as shown in FIG. 2. Additionally, the spring member which urges the first holding member to move angularly, as illustrated by the torsion spring 6 shown in FIG. 1, may also comprise a coiled compression spring 6' as shown in FIG. 3. Specifically, the spring 6' is disposed between the end of the first holding member 3' which extends rearwardly beyond the floating fulcrum 5' and the lower end of the second holding member 4', and urges the first holding member 3' to move angularly in a direction to bring the forward edge of the blade 1 into abutment against the surface of the carrier 2, in the similar manner as described above in connection with FIG. 1. While not shown, a similar result can be obtained by the use of a coiled tension spring extending between the lower end of the second holding member 4' and a point on the first holding member 3' which is located to the right of the floating fulcrum 5'.

While the invention has been shown and described above in connection with several specific embodiments, it should be understood that a number of modifications and changes will readily occur to those skilled in the art from the disclosure given above. Hence, it is intended that all such modifications and changes be included within the appended claims which define the present invention.

What is claimed is:

1. A cleaning blade unit for removing any residual toner from the surface of a latent image carrier after a transfer step, comprising a cleaning blade disposed in contact with a surface of the latent image carrier at an angle which is equal to or less than 90°;

a first holding member for holding the blade;

a second holding member for carrying the first holding member in an angularly movable manner which is pivotally mounted on the unit;

a spring member engaging both the first and the second holding member and urging the first holding member to move angularly in a direction to bring the forward edge of the blade into abutment against the surface of the latent image carrier; and a bias member for urging the second holding member to move angularly in the same direction as the first holding member.

2. A cleaning blade unit according to claim 1 in which both the first and the second holding members are formed by arms.

3. A cleaning blade unit according to claim 1 in which the spring member comprises a torsion spring.

4. A cleaning blade unit according to claim 1 in which the spring member comprises a coiled compression spring.

5. A cleaning blade unit according to claim 1 in which the spring member comprises a coiled tension spring.

6. A cleaning blade unit according to claim 1 in which the bias member comprises a coiled compression spring.

7. A cleaning blade unit according to claim 1 in which the bias member comprises a weight.

* * * * *